US005259479A

United States Patent [19]

St-Germain

[11] Patent Number: 5,259,479

[45] Date of Patent: Nov. 9, 1993

[54] SELF-RAISING CANTILEVER-TYPE WORK PLATFORM ASSEMBLY

[75] Inventor: André St-Germain, Sainte-Marthe-sur-le-Lac, Canada

[73] Assignee: Gestion des Brevets Fraco Ltée, St-Mathias, Canada

[21] Appl. No.: 775,909

[22] Filed: Oct. 15, 1991

[51] Int. Cl.[5] ..... E04G 1/20

[52] U.S. Cl. ..... 182/146; 182/82

[58] Field of Search ..... 182/146, 102, 103, 101, 182/130, 123, 63, 145, 118, 132, 131, 82, 222, 229

[56] References Cited

U.S. PATENT DOCUMENTS

| | | | |
|---|---|---|---|
| 279,740 | 6/1883 | Gillett | 182/146 |
| 3,197,178 | 7/1965 | Nietz | 182/130 X |
| 3,318,414 | 5/1967 | Meek | 182/146 X |
| 3,323,616 | 6/1967 | Best | 182/146 X |
| 3,908,801 | 9/1975 | Pohlman | 182/103 X |
| 4,418,791 | 12/1983 | Frey-Wigger | 182/63 X |
| 4,809,814 | 3/1989 | St. Germain | 182/146 X |
| 5,067,587 | 11/1991 | Mims, Jr. et al. | 182/63 |

FOREIGN PATENT DOCUMENTS

| | | | |
|---|---|---|---|
| 532446 | 8/1931 | Fed. Rep. of Germany | 182/145 |
| 625646 | 8/1927 | France | 182/145 |
| 590423 | 7/1947 | United Kingdom | 182/103 |

*Primary Examiner*—Karen J. Chotkowski

*Attorney, Agent, or Firm*—Pierre Lespérance; François Martineau

[57] ABSTRACT

The self-raising work platform assembly is of the cantilever type in that it comprises a single tower, a sleeve surrounding and guided along said tower for up-and-down movement, power-operated raising means for said sleeve and a pair of horizontally-extending cantilever work platforms attached to said sleeve on opposite sides thereof. A second pair of oppositely-extending work platforms are disposed above the first pair and guy wires interconnect the work platforms.

18 Claims, 7 Drawing Sheets 16
104
166
86
88
94
83
108
110
83a
84
82
86'
14

86a
84a
86a
83a
82
83
100
84
88
86'
86
84

38
2
6
66
80
90
78
86a
110
108
106
104
83
84a
86
83a
82

82
86a
88
82
84a
84
92

14
82
83
100
96
83a

SELF-RAISING CANTILEVER-TYPE WORK PLATFORM ASSEMBLY

FIELD OF THE INVENTION

The present invention relates to work platforms which can be raised along a building structure, so that workmen can effect work on the latter.

BACKGROUND OF THE INVENTION

U.S. Pat. No. 4,809,814 dated Mar. 7, 1989, entitled: SCAFFOLDING, inventor Jean St-Germain, describes a scaffolding including a pair of towers each made of tower sections adapted to be secured in end-to-end relation, a work platform completely surrounding said towers and hydraulically-operated hooks extendable and retractable along the towers and selectively engaging steps of said towers to raise the platform along the towers. Although the work platform assembly in accordance with the above-noted invention has been found to be a great improvement over conventional manually-erected scaffoldings, certain inconveniences have been found in practice, such as the need to climb down the platform onto a suspended swing stage for the installation of cross-braces interconnecting the towers and of anchors to secure the towers to the building wall, these operations being effected every time the platform is raised a certain amount. The removal of the braces and of the anchors needs also to be effected in the same manner every time the platform is lowered.

A further disadvantage of the scaffolding of this prior patent resides in the fact that several work platforms cannot be suspended at different levels from the main work platform due to the existence of the cross-braces, thereby restricting concurrently effected work at a single level, namely the platform level.

Another disadvantage of the above-noted system resides in the fact that the hydraulically-operated platform raising means is an expensive raising mechanism which also entails frequent maintenance due to the working environment in which it is located.

Another disadvantage of the system is that for each platform, two columns or towers are required, resulting in a time-consuming and expensive installation for a given platform length.

OBJECTS OF THE INVENTION

The general object of the present invention is the provision of a self-raising work platform assembly designed to overcome the above-noted disadvantages.

Another object of the invention is to provide a work platform assembly which is more flexible than the above-noted system.

Another object of the invention is to provide a work platform assembly which is of simple and inexpensive construction in that a single tower is required.

SUMMARY OF THE INVENTION

The work platform assembly of the invention comprises a single tower adapted to be positioned adjacent a building structure, vertically-spaced anchor means fixed to said tower and adapted to be fixed to said building structure to maintain said tower upright, an elongated sleeve-like member surrounding and movable up and down the tower and having a longitudinally-extending slit opening at both ends of said sleeve to clear said anchor means, guiding means guiding the sleeves for up-and-down movement along the tower, lifting means interconnecting the tower and the sleeve to raise the sleeve and allow the sleeve to be lowered by gravity along the tower, a first pair of joist structures, of substantially equal length weight and weight distribution along their length, fixed at their inner ends to opposite sides of said sleeve and horizontally extending in opposite direction to substantially counterbalance each other and flooring supported by the joist structures.

Preferably, each joist structure is formed of modular elongated sections releasably secured in end-to-end relations. Each modular section is preferably made of lattice work, is box shaped and is of quadrangular cross-section defining end portions formed· with vertical members and top transverse members, one end of each modular section having upwardly-directed hooks to receive the top transverse member of an adjacent modular section, with the vertical members of the two modular sections in abutting relation, so as to maintain the modular sections in alignment.

Similarly, the sleeve has vertical longitudinal members carrying upwardly-directed hooks for receiving the transverse member of a modular section, with the vertical members of the same in abutment against the longitudinal members of the sleeve to thus maintain the modular sections in horizontal position.

Preferably, two levels of pairs of joist structures are provided with the joist structures of the upper level being shorter than those of the lower level, and superposed joist structures being interconnected by guy wires at their outer end portions.

Preferably, chain blocks are used as lifting means.

An emergency braking system is provided, which automatically stops descent of the sleeve when the descending speed is above a predetermined normal descending speed. Otherwise, the emergency braking system automatically allows normal descending movement as well as ascending movement of the sleeve.

A telescopic bridging frame can be used to interconnect the outer ends of two joist structures disposed at the same level and belonging to two adjacent self-raising work platform assemblies.

DETAILED DESCRIPTION OF THE PREFERRED EMBODIMENT

Figures 2, 3:
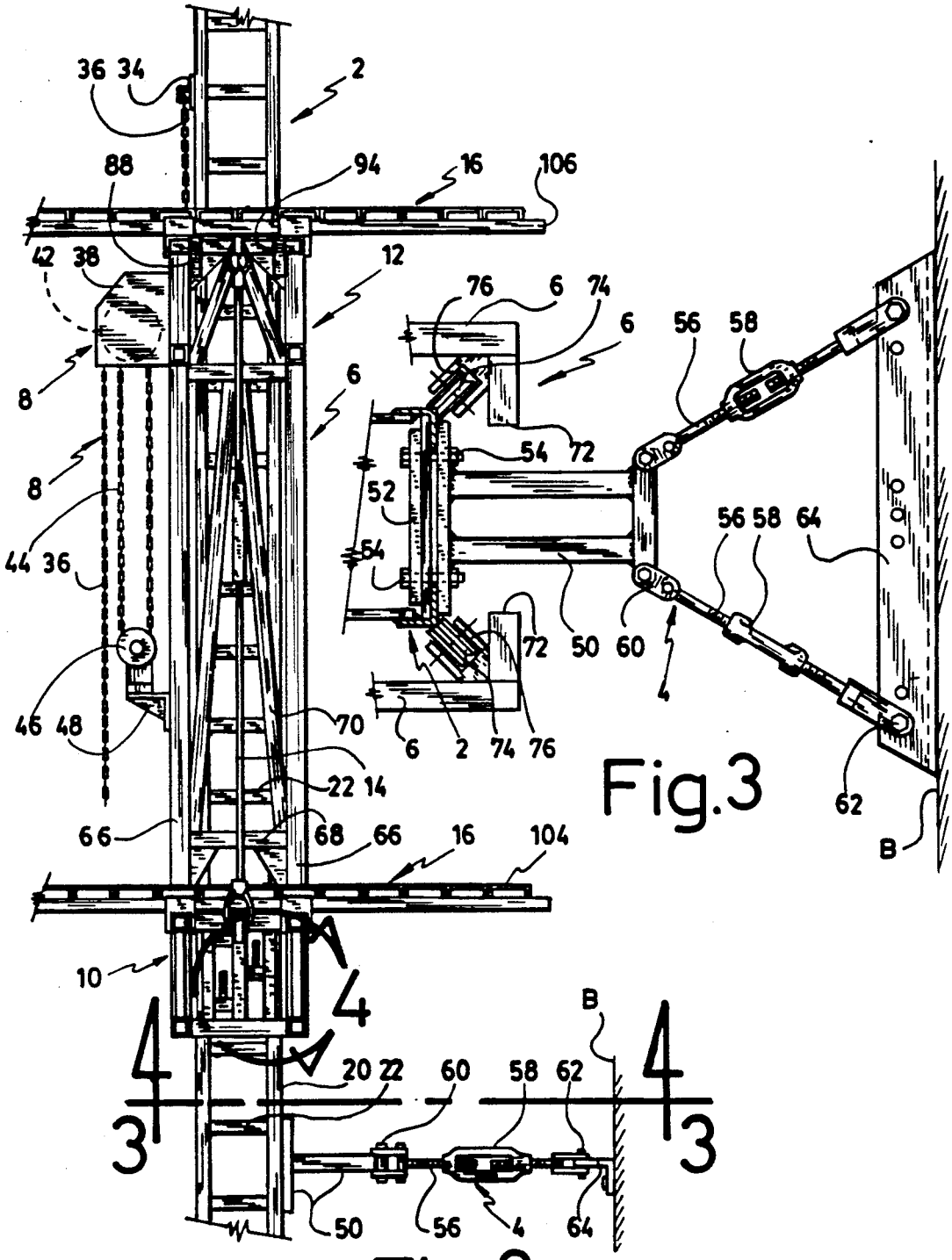
FIG. 2 is an end view, partially in section, taken along line 2—2 of FIG. 1.
FIG. 3 is a plan view, partially in section, taken along line 3—3 of FIG. 2.

The work platform assembly of the invention comprises a single tower 2, which, as shown in FIGS. 2 and 3, is secured adjacent a building structure B by a series of vertically-spaced anchors 4 which maintain the tower 2 in upright position. A sleeve 6 surrounds the tower 2 and is guided along the same for up-and-down movement under the action of a lifting means, namely a chain block B. Sleeve 6 supports in horizontal position a lower pair of joists 10 and an upper pair of joists 12. Guy wires 14 interconnect the outer end portions of the upper joists 12 to the lower joists 10. The lower joists 10 can be made longer than the upper joists 12, in the particular example shown, they are twice as long. In order to properly counterbalance the assembly of the two resulting platforms, the joists 10 and 12 must be of substantially equal length, of equal weight and of equal weight distribution along their length. In this manner, lateral tilting of the tower and of the platforms is prevented and also the platforms can be unequally loaded up to a certain extent, the resulting tilting force on the tower being resisted by the anchors 4.

The joists 10 and 12 support a flooring 16 to complete the work platform.

Referring to FIGS. 14 to 17, it is seen that the tower 2 is, made of tower sections 18, adapted to be removably secured to each other in end-to-end relationship. Each tower section is of square cross-sectional shape, for instance 12 inches by 12 inches, and includes at the four corners longitudinal angle bars 20 joined together by equally-spaced transverse bars 22, 24 and diagonal bars 26 on the same sides as bars 24. Transverse flat bars 28 and angle bars 30 are secured at opposite ends of the angle bars 20 and are provided with holes 32 which register in pairs to receive bolt-and-nut means to secure the tower sections together. Transverse bars 22 or 24 form a series of equally spaced steps to allow a workman to climb up the tower and attach to a selected step the hook 34 of the primary chain 36 of the chain block 8, so that the sleeve 6, together with the sets of platforms can be raised or lowered along tower 2.

Figure 1:
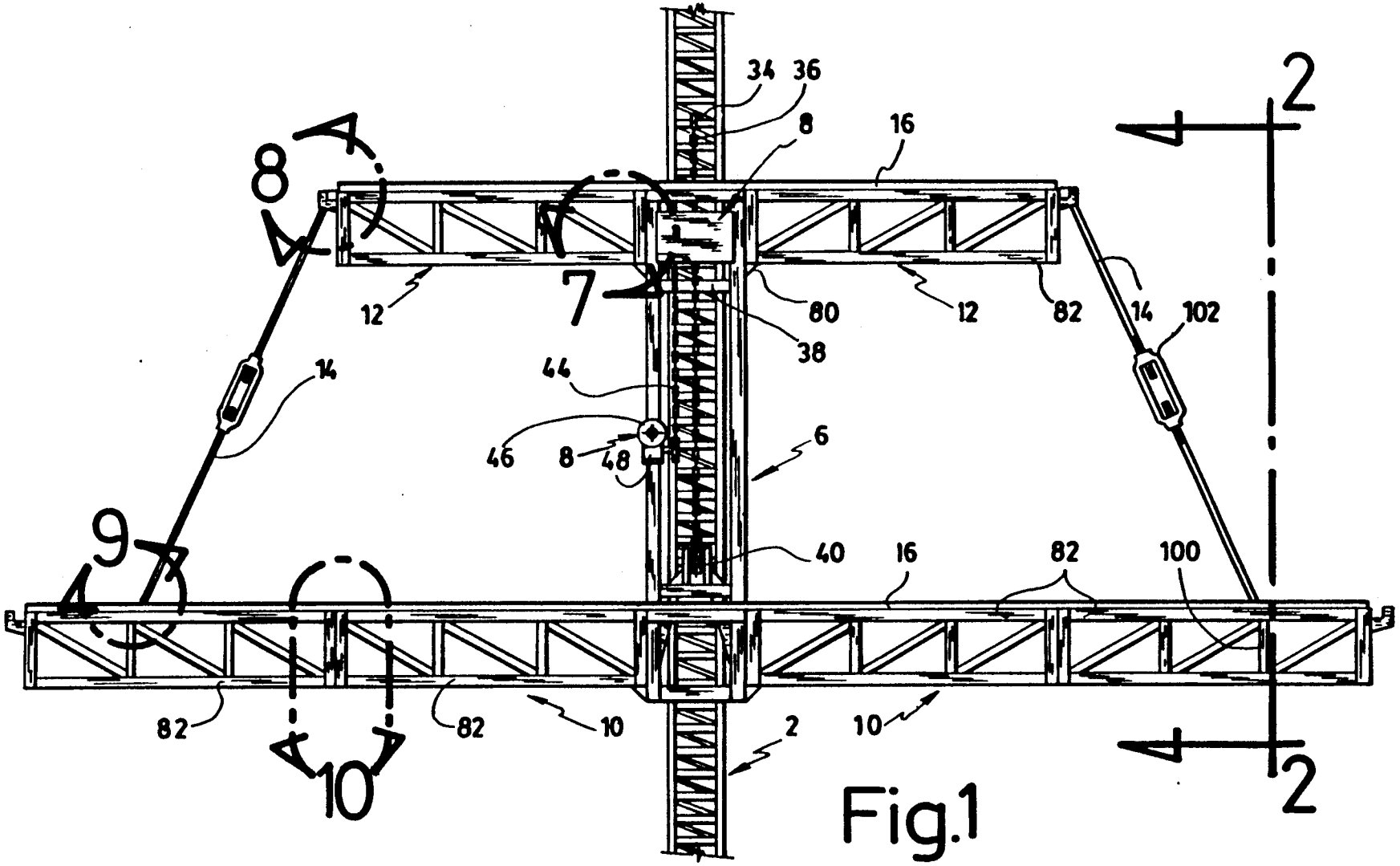
FIG. 1 is a partial front elevation of the single tower and of the two level cantilever work platforms carried by the same.

The chain block 8 is of conventional construction. Its arrangement is described in more detail in applicant's U.S. Pat. No. 5,159,993 entitled: SELF-RAISING WORK PLATFORM ASSEMBLY. More particularly, the chain block housing 38 is mounted at the top of the sleeve 6 and the primary chain 36 extends from the hook 34 around a return pulley 40 carried by the lower end of the sleeve 6 (see FIG. 1), and finally in engagement with the chain intermeshing driving pulley 42 within the chain block housing 38. The main pulley 42 is driven through a speed reducer, the input of which is actuated by a secondary chain 44 actuated at its lower end by an electric motor driving a secondary pulley through a speed reducer, the whole unit, indicated at 46, being mounted on a shelf 48 fixed to the sleeve 6.

Referring to FIGS. 2 and 3, each anchor 4 includes a bracket 50 secured to the tower 2 by a retaining plate 52 and bolts 54. A pair of tie-rods 56, each made of two sections interconnected by a buckle 58, are pivotally connected at 60 to the bracket 50, and at 62 to an angle bar 64 adapted to be removably secured to the building structure B at the proper level. The tie-rods 56 are diverging towards the building structure and the buckles 58 can be independently adjusted. The proper vertical positioning of the tower 2 is obtained and also the tie-rods resist lateral tilting of the tower in all directions, including lateral tilting in the direction of the platforms up to a certain extent.

The sleeve 6 is also of square cross-section, and includes longitudinal members 66, transverse members 68, and diagonal members 70, all welded together to form a rigid unit. As shown in FIG. 3, the sleeve side facing towards each building structure B has a longitudinal slit 72 opening at both ends of the sleeve and serving as a clearance for the successive brackets 50 of the anchors 4, so that the sleeve 6 cannot interfere with the anchors 4 during its up-and-down movement along tower 2.

The sleeve 6 is guided along the tower 2 by an upper and a lower set of guiding wheels 74 carried by ears 76 fixed to the lower and upper end of the sleeve 6. The guiding wheels 74 have a V-shape groove for engaging the two right angle faces of the angle bars 20, the guiding wheels 74 being set at 45 degrees with respect to the sides of the tower 2.

Figure 5:
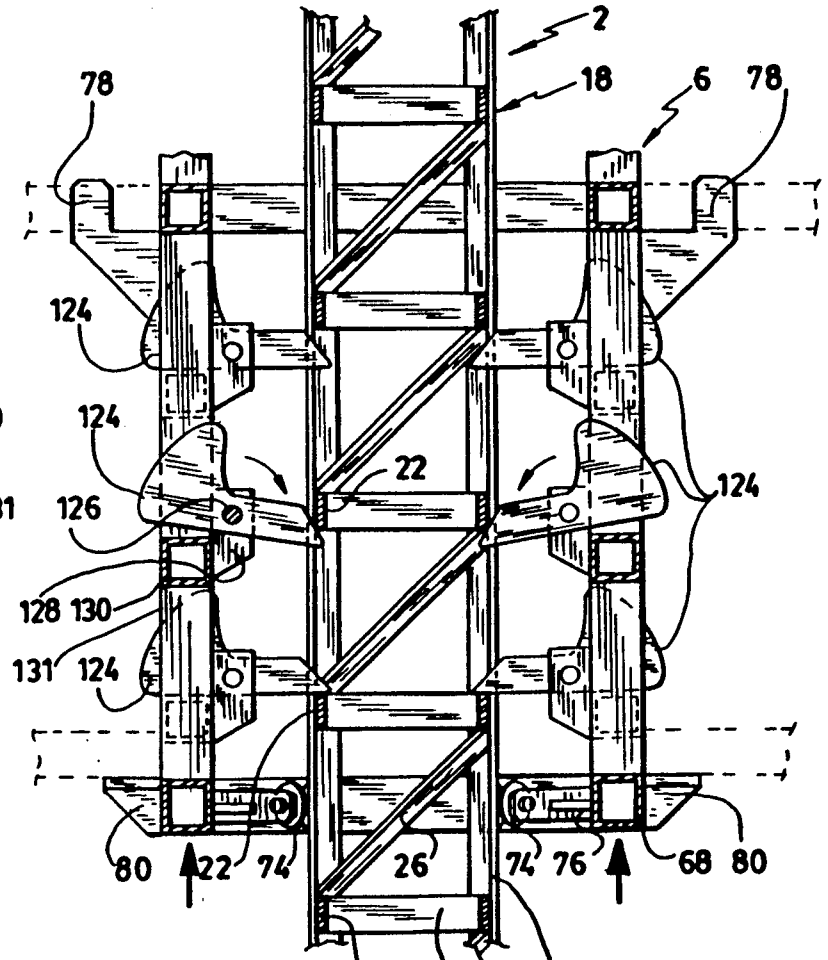
FIG. 5 is a partial section, taken along line 5—5 of FIG. 4.
Figure 4:
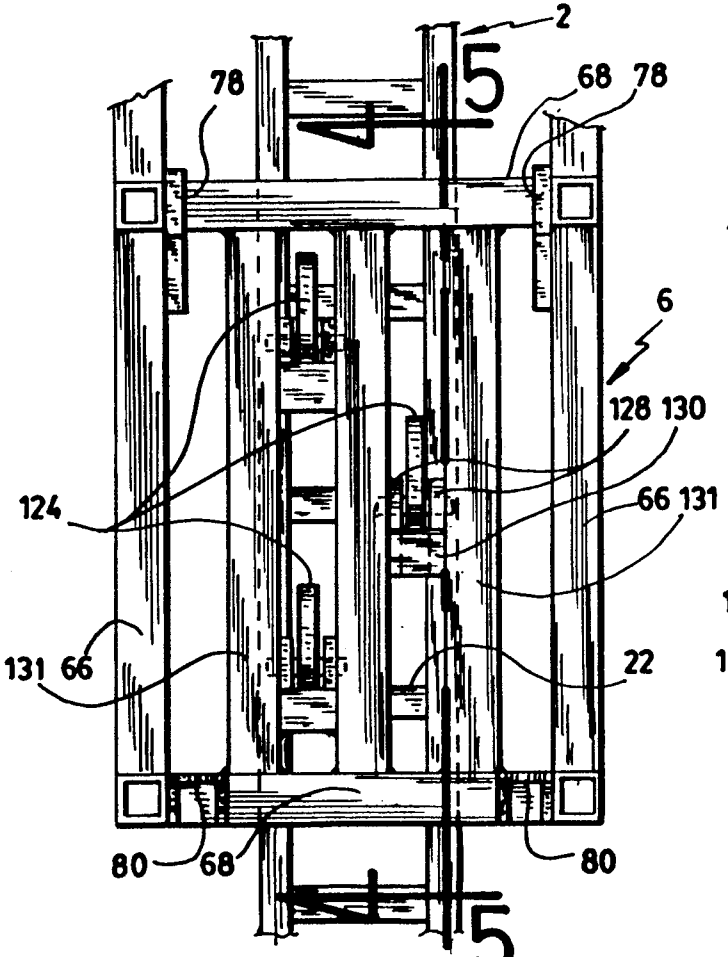
FIG. 4 is a front elevation, taken within circle 4 of FIG. 2.
Figures 7, 8, 9, 10, 11:
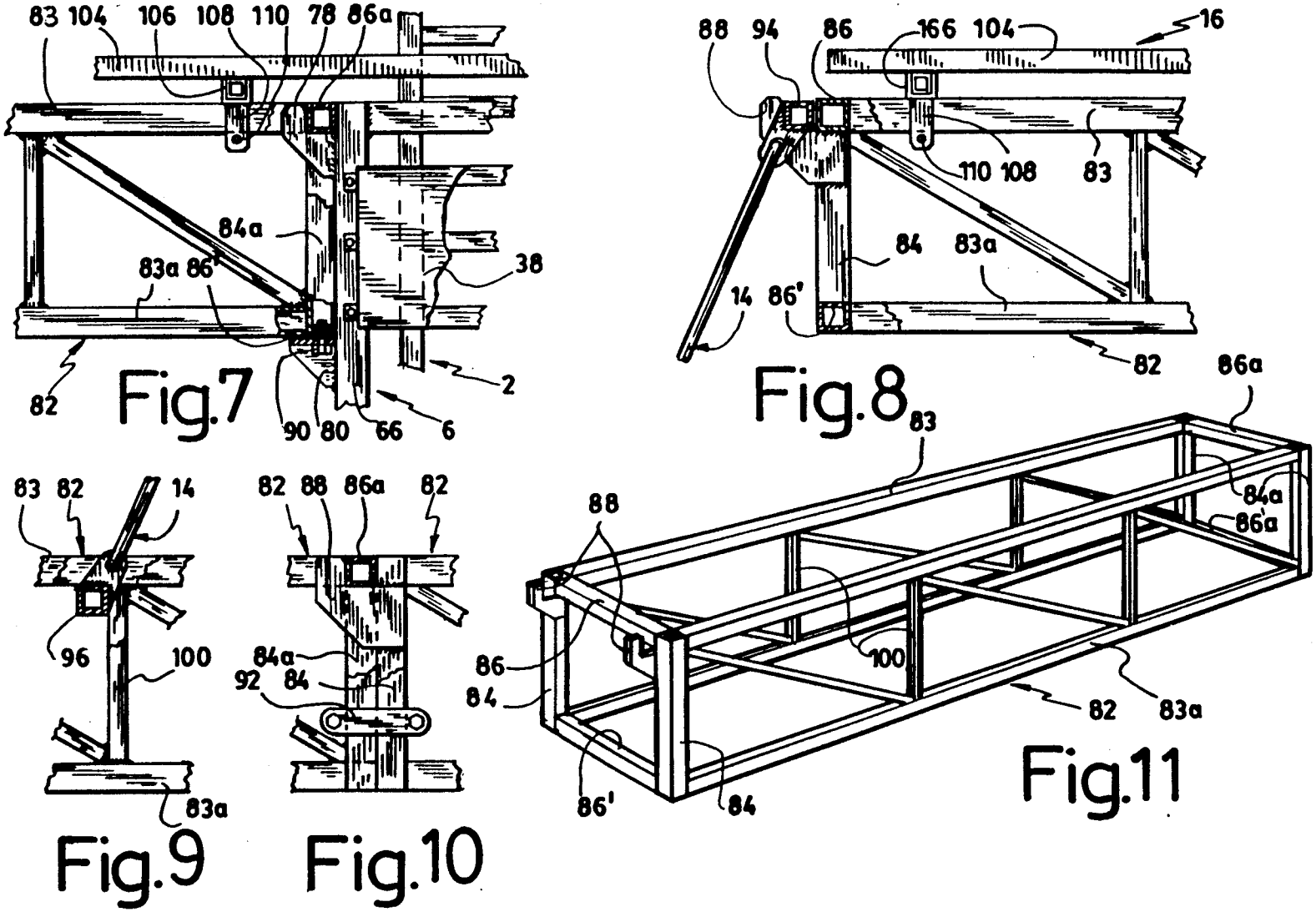
FIGS. 7, 8, 9 and 10 are partial sections, taken along circles 7, 8, 9, and 10, respectively of FIG. 1.
FIG. 11 is a perspective view of one modular section of the joist structures.

Referring to FIGS. 4, 5 and 7, the lower and upper sections of the sleeve 6 are each provided with two outwardly-protruding hooks 78 respectively secured to the two longitudinal members 66 and a pair of brackets 80 are secured to a transverse member 68 of the sleeve 6, vertically below hooks 78. The hooks 78 are upwardly opening and serve, together with the brackets 80, to secure to the sleeve, the lower and upper pairs of joists 10 and 12 respectively.

The sets of hooks and brackets 78 and 80 are disposed on the parallel sides of the sleeve 6, which are normal to the side provided with slit 72.

Each joist 10 or 12 is composed of one or more modular joist sections 82, more particularly shown in FIGS. 1 and 7 to 11. Each joist section 82 is elongated and box shaped, of generally rectangular cross-section, made of lattice work including top and bottom longitudinal stringers 83, and 83*a*, and at each end a pair of laterally-spaced vertical members 84 and 84*a* interconnected by top and bottom horizontal transverse members 86, 86*a*, 86′, 86′*a*. One end of the joist section 82 is provided with a pair of upwardly-extending hooks 88 similar to hooks 78 secured to the sleeve 6. These hooks 88 are fixed to the vertical members 84 adjacent the top horizontal transverse member 86. The other end of section 82 defined by members 84*a* and 86*a*, 86 has no hook. All the joist sections 82 are of similar dimensions and weight, as shown in FIG. 7. The top transverse members 86*a* of one joist section is directly inserted into the hooks 78 of sleeve 6, and the vertical members 84*a* abut directly against the longitudinal members 66 of the sleeve 6, while the bottom transverse member 86′ of the joist section rests on the brackets 80, where they can be secured by bolt-and-nut 90 extending through registering holes of the bracket 80 and of the bottom transverse member 86′ of the joist section 82. The pair of hooks 88 of the joist section 82, which are now at the outer end of the joist, are adapted to receive the top transverse member 86*a* of the next joist section, as shown in FIG. 10, and the vertical members 84, 84*a* of the two contiguous joist sections abut each other and they are preferably joined together at their lower ends by a clamp 92.

The pair of hooks 88 of the outermost joist section 82 of the upper joist 12 are used to attach the upper end of the guy wire 14, as shown in FIG. 8. For this purpose, the upper end of each guy wire 14 is attached to the middle of a transverse retaining member 94 releasably inserted within these hooks 88. Similarly, the lower end of the guy wire 14 is attached to the middle of a transverse retaining member 46, which is removable retained underneath the top longitudinal stringers 83 of joist section 82 and against a pair of vertical members 100 intermediate the ends of the outermost joist section 82 of the lower joist 10. In this manner, the guy wires which protrude from the center plane of the lower joist allow the workman on the lower platform to move on either side of the guy wire. Each guy wire 14 is made of two section interconnected by a buckle 102 for adjusting the effective length of the same.

FIGS. 2, 7, and 8 show the construction of the flooring 16. It is composed of a plurality of channels 104 disposed side by side and longitudinally extending with respect to the joists 10 or 12 and supported by transverse tubular members 106 resting on the top stringers 83 of the joist sections 82 and secured thereto by a pair of ears 108, depending from and fixed to the transverse member 106 and straddling the top stringer 83 of the joist section 82 and pressed against the same by a bolt-and-nut 110.

As shown in FIG. 2, both the lower and upper platforms can be made much wider than the sleeve 6 and provide a passage from one side to the other of the tower 2.

Figure 13:
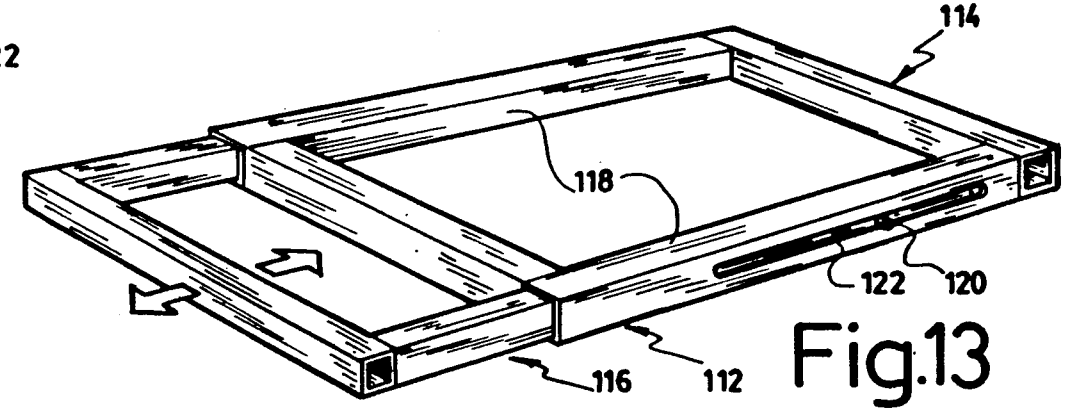
FIG. 13 is a perspective view of the telescopic frame shown within area of FIG. 12.
Figure 12:
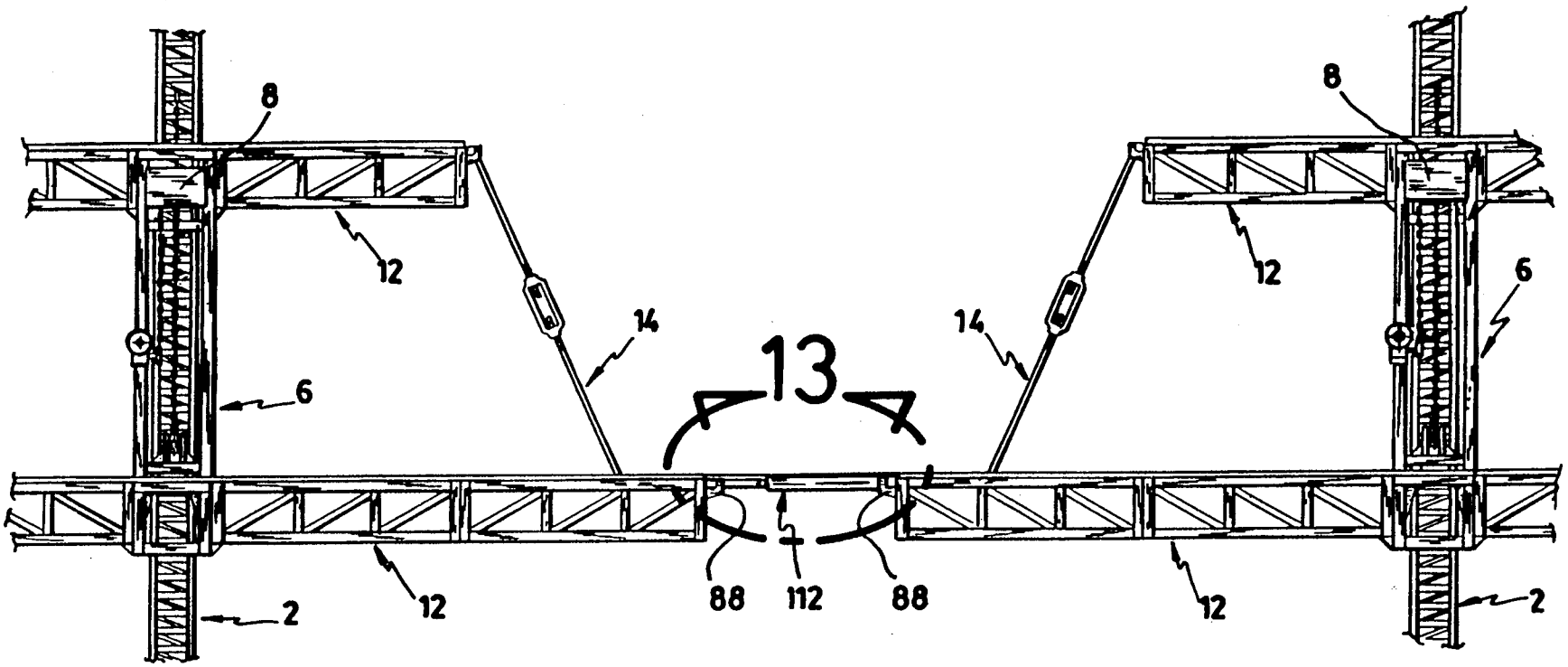
FIG. 12 is a partial side elevation of two assemblies of the invention, interconnected by a telescopic bridging frame.
Figure 16:
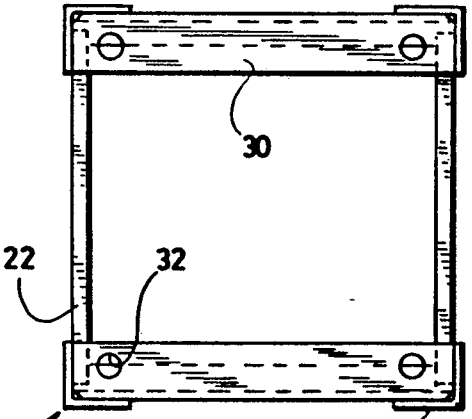
FIGS. 16 and 17 are end views, taken along line 16 and 17, respectively, of FIG. 14.
Figure 17:
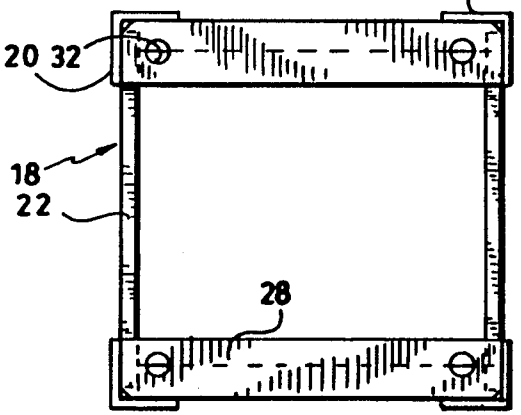
Figure 14:
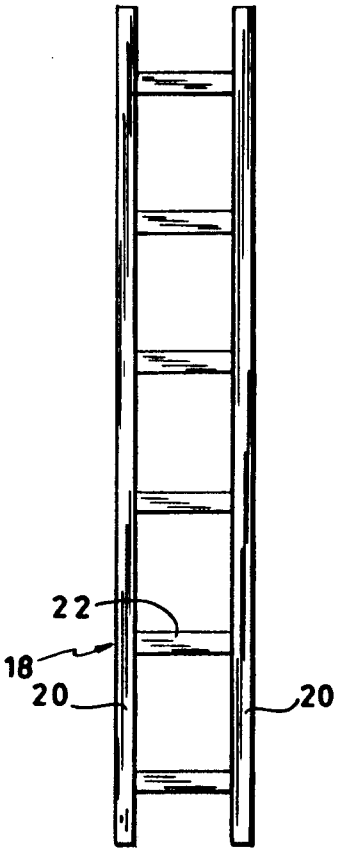
FIG. 14 is a front elevation of one tower section.
Figure 15:
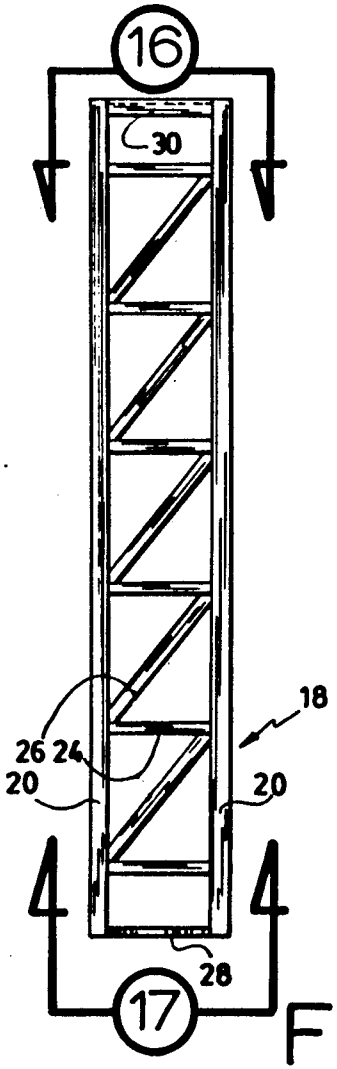
FIG. 15 is a side elevation of the tower section.

Referring to FIGS. 12 and 13, it is seen that two work platform assemblies in accordance with the invention can be arranged side by side along a building wall, with the lowermost platforms at the same level and interconnected by a bridging frame 12, also supporting the flooring 16 consisting of the channels 104. Bridging frame 112 includes two telescopic sections, namely: outer section 114 and inner section 116. Outer section 114 forms a rectangular frame, made of tubular members, and its longitudinal members 118 are open at one end to telescopically receive the legs of the U-shaped inner telescopic section 116. These legs are provided with an outwardly-protruding stop pin 120 extending through a slot 122 of longitudinal members 118, so as to prevent separation of the two sections 114, 116, the stop pins 120 reaching the ends of the slots 122 during extension of the bridging frame 112.

The ends of the bridging frame 112 are inserted within the hooks 88 protruding from the lower joist 10 of the two adjacent platform assemblies.

The sleeve 6, together with the lower and upper cantilever platform assemblies carried thereby, can be raised along the tower by the chain block 8, a stroke depending on the location of the chain hook 34 on the tower 2 above the lower return pulley 40.

The platform assembly is lowered under gravity under the control of the chain block 8. Therefore, the platform assembly descends at a generally uniform slow speed which is called a predetermined descending speed. An emergency braking system is provided to automatically stop descent of the platform assembly in an emergency wherein the above-noted predetermined descending speed is exceeded, due, for instance, to breakage of the primary cable or for any other reason.

Figure 6B:
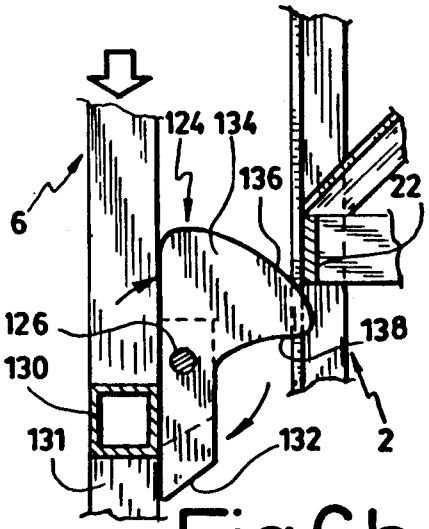
FIGS. 6, 6A, 6B, and 6C are partial views showing one of the emergency brake levers of FIGS. 4 and 5 shown in different positions.
Figure 6A:
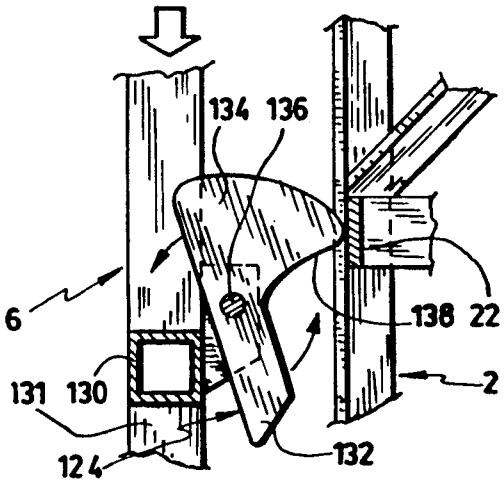
Figure 6:
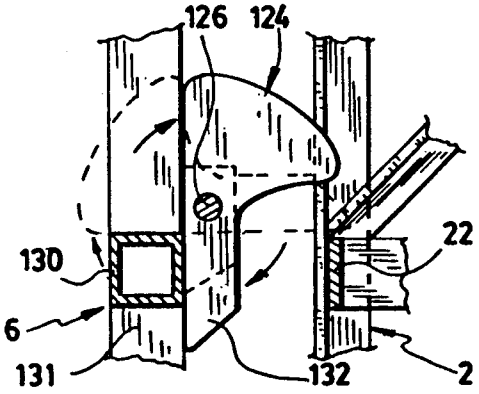

The emergency braking system is more particularly illustrated in FIGS. 4, 5, and 6, 6A, 6B, and 6C. Each of two opposite sides of the sleeve 6 carries a series of three vertically-spaced levers 124 pivoted intermediate its ends for pivotal movement in a vertical plane about a horizontal pivot pin 126 carried by ears 128 fixed to a transverse member 130 fixed to upright reinforcing member 131 of the sleeve 6. The pivot pin 126 is located upwardly and inwardly with respect to the transverse member 130, so that the latter acts as an abutment member which limits pivotal movement of said lever 124 between a vertical limit position, as shown in FIG. 6, and a horizontal limit position, as shown in dotted line in FIG. 6 and also in FIG. 6C. When lever 124 is horizontal, its inner bevelled end 132 is in the path of the successive steps of sleeve 6 formed by its transverse bars 22 and when it comes to rest on a sleeve step 22, the sleeve 6 cannot descend any longer. This sleeve-stopping position is shown by the lower pair of levers 124 in FIG. 5.

Figure 6C:
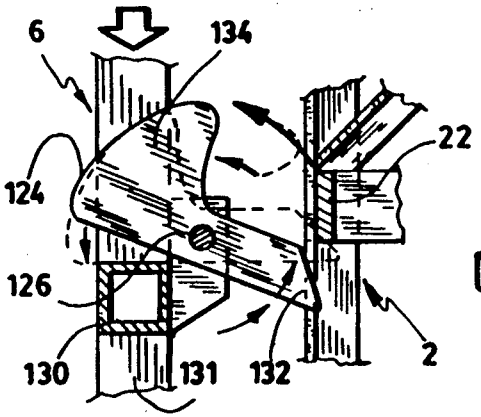

The outer end of each lever 124 is enlarged to form a counterweight 134, in the form of a cam which laterally upwardly protrudes from the top side of the lever when the latter is seen in horizontal limit position. This cam-shaped counterweight 134 defines outwardly-converging outer and inner cam edges 136 and 138 respectively. Each lever 134 is free to pivot between its horizontal and vertical limit positions. The cam-shaped counterweight 134 confers a greater weight to the part of the lever external to the pivot pin than the part of the lever internal to said pivot pin. When the bevel end 132 is downwardly extending, the lever is in an unstable equilibrium in that from a predetermined downwardly-inclined position, approximately shown in FIG. 6A, the lever will automatically return to its vertical limit position under the action of the counterweight 134, if the lever has not reached this predetermined inclined position when pivoting from the vertical limit position to the horizontal limit position. If, during this movement, the lever moves past said predetermined inclined position, then the counterweight 134 will automatically cause the lever to pivot further until it reaches its horizontal limit position. Assuming the lever is in vertical position, as shown in FIG. 6 during raising movement of the sleeve 6 along the tower, the outer cam edge 136 abuts the underside of successive steps 22 of the tower 2 at a slow enough speed so that the lever cannot pivot beyond the above-noted predetermined inclined position; past each step, the lever automatically returns to its vertical position. The same action occurs when the sleeve descends along the tower at a slow, normal speed as produced by the operation of the chain block. As shown in FIGS. 6A and 6B, the inner edge 138 successively abuts against the top edge of the sleeve step 22 with insufficient force to cause anticlockwise movement of the lever past its predetermined inclined position, so that the lever automatically returns to its vertical limit position, as shown in FIG. 6B. Thus, normal descending movement of the sleeve is not prevented. However, should the descending movement exceed the predetermined normal speed, then the inner cam edge 138 will strike the top edge of the transverse step 22 with sufficient force to cause counterclockwise pivotal of the lever past its equilibrium-inclined position and the counterweight 134 will automatically cause the lever to further pivot to its horizontal limit position in which, as seen in FIG. 6C, the bevelled inner end 132 will engage the next lower step 22 and stop the sleeve 6.

In order to prevent the free fall of the platform assembly through a distance less than the vertical distance between the successive steps 22 of the tower, there are provided a set of three levers 124 on each side of the tower and the vertical distance between the successive levers of each set is less than the vertical distance between the successive steps 22.

In the use of the invention, a first series of tower sections 18 are first assembled on the ground and then lifted with a tower crane, or the like, to an upright position, and additional towers sections can be added at ground level with the lowermost section inserted into upright sleeve 6. Once the desired height has been achieved, the whole tower is anchored to the building structure B by means of the anchors 4. The upper and lower platform assemblies are assembled and fixed the sleeve 6 at ground level. The work platform arrangement is very inexpensive and can be adapted for a variety of applications, since a single tower is used.

I claim:

1. A self-raising cantilever-type work platform assembly comprising a single tower adapted to be spacedly positioned adjacent a building structure, vertically-spaced anchor means fixed to said tower and adapted to be fixed to said adjacent building structure to maintain said tower upright, an elongated sleeve surrounding and movable up and down said tower and having a longitudinally-extending slit opening at both ends of said sleeve to clear said anchor means, guiding means guiding said sleeve for up-and-down movement along said tower, lifting means interconnecting said tower and said sleeve to raise said sleeve and allowing lowering of said sleeve by gravity along said tower, a first pair of cantilever joist structures, of substantially equal length, weight and weight distribution along their length, releasably fixed at their inner ends to said sleeve and horizontally extending in opposite directions to substantially counterbalance each other, and flooring supported by said first pair of joist structures.

2. A self-raising cantilever-type work platform assembly as defined in claim 1, wherein said joist structures are formed of modular, elongated sections releasably secured to each other in end-to-end relation.

3. A self-raising cantilever-type platform assembly as defined in claim 2, wherein said modular sections are made of lattice work, are box shaped and are of quadrangular cross-section defining a pair of laterally-spaced upright members at each end; and further including a pair of upwardly-directed hooks at one end of each modular section, respectively fixed to the upper ends of said upright members, the opposite end of said modular sections having a top transverse member adapted to be releasably inserted into the hooks of an adjacent modular section, with the upright members of the two hooked modular sections in mutual abutment to maintain the two modular sections in alignment.

4. A self-raising cantilever-type work platform assembly as defined in claim 3, wherein said sleeves includes two parallel sides normal to the side to which said anchor means are fixed; and further including a pair of upwardly-directed hooks fixed in transversely-spaced relation to each of said parallel sides of said sleeve, said sleeve including vertical longitudinal members downwardly extending from the respective hooks, the top transverse member at one end of one of said modular sections releasably inserted into said pair of hooks of said sleeve with the adjacent upright members of said modular section abutting against the longitudinal members of said sleeve to maintain said modular section in horizontal position.

5. A self-raising cantilever-type work platform assembly as defined in claim 1, further including a second pair of joists structures releasably fixed to said sleeve, each joist structure of the second pair extending horizontally above a joist structure of the first pair.

6. A self-raising work platform assembly as defined in claim 5, further including guy wire means interconnecting the outer end portions of the first and second pairs of joist structures of said first and second pairs.

7. A self-raising work platform assembly as defined in claim 5, wherein the joist structures of said first pair are longer than the joist structures of the second pair.

8. A self-raising work platform assembly as defined in claim 1, further including a bridging frame, made of two telescopic sections supported at one end by the outer end of said first joist structure and adapted to be supported at its other end to the outer end of an adjacent same level joist structure of another self-raising work platform assembly.

9. A self-raising cantilever-type work platform assembly as defined in claim 1, wherein said tower and said sleeve have a square cross-sectional shape and said sleeve has longitudinally-extending vertical members at the four corners thereof, two pairs of upwardly-directed hooks fixed to and protruding from said vertical members, and each joist structure includes a transverse member and a pair of vertical transversely-spaced members at one end, said transverse member adapted to be inserted into said hooks with the vertical members of said joist structure abutting against the vertical members of said sleeve.

10. A self-raising cantilever-type work platform assembly as defined in claim 6, wherein each guy wire means includes a guy wire with a turn-buckle and secured at each end to the center of a transversely-extending bar, said bars releasably secured to said first and second pairs of joist structures.

11. A self-raising cantilever-type work platform assembly as defined in claim 1, wherein said anchor means includes a bracket removably secured to said tower; an anchor member adapted to be removably secured to said building structure and longitudinally adjustable tie-rods pivotally connected to said bracket and to said anchor member and outwardly diverging towards said anchor member.

12. A self-raising cantilever-type work platform assembly as defined in claim 1, wherein said tower is formed of tower sections releasably secured to each other in end-to-end relation, each tower section being of quadrangular cross-section with longitudinally-extending angle bars at each of the four corners thereof, said sleeve carrying at each end a set of four idle wheels with a V-groove engaging said angle bars, said wheels and said angle bars forming said guiding means.

13. A self-raising cantilever-type work platform assembly as defined in claim 1, wherein said lifting means includes a chain block having a chain with a hook to be removably secured to the tower, and a chain-driving pulley with a speed reducer carried by said sleeve.

14. A self-raising cantilever-type platform as defined in claim 1, further including an emergency braking system carried by said sleeve and automatically biased under gravity into a sleeve-stopping position engaging said tower when said sleeve descends along said tower at a speed exceeding a predetermined speed.

15. A self-raising cantilever-type work platform assembly as claimed in claim 14, wherein said tower includes a plurality of vertically-spaced steps and said braking system comprises a lever pivoted to said sleeve intermediate its first and second end portions for pivotal movement about a lever pivot in a vertical plane between a vertical and a horizontal limit position, lever abutment means carried by said sleeve to abut said lever in said limit positions, said first end portion being, when said lever is in horizontal limit position, in the path of said steps and resting on one of said steps, and being, when said lever is in vertical limit position, disposed at a lower level than said lever pivot, said second end portion extending in the path of said steps in the vertical limit position of said lever and forming a lever counterweight biasing said lever towards its vertical limit position in a range of lever positions between said vertical limit position and a vertically-inclined position in which said second end portion just clears said steps, said lever counterweight biasing said lever towards its horizontal limit position in a range of lever positions between said horizontal limit position and said vertically inclined position, whereby, upon slow raising or lowering movement of said sleeve along said tower, said lever oscillates between said vertical limit position and said vertically inclined position and upon lowering movement of said sleeve at a sufficient speed to cause said lever by impact of said second end portion on a step, to pivot from said vertical limit position beyond said vertically inclined position, said lever will continue to pivot and attain its horizontal limit position under the bias of said lever counterweight.

16. A self-raising cantilever-type work platform assembly as defined in claim 15, wherein said emergency brake system includes additional levers identical to said lever and vertically pivotally mounted on said sleeves at substantially equal vertical distances apart smaller than the vertical distance between successive steps of said tower.

17. A self-raising cantilever-type work platform assembly comprising a single tower adapted to be spacedly positioned adjacent a building structure, vertically-spaced anchor means fixed to said tower and adapted to be fixed to said adjacent building structure to maintain said tower upright, an elongated sleeve surrounding and movable up and down said tower and having a longitudinally-extending slit opening at both ends of said sleeve to clear said anchor means, guiding means guiding said sleeve for up-and-down movement along said tower, lifting means interconnecting said tower and said sleeve to raise said sleeve and allowing lowering of said sleeve by gravity along said tower, said tower including equally vertically-spaced steps, and an emergency braking system comprising a lever pivoted to said sleeve intermediate its first and second end portions for pivotal movement about a lever pivot in a vertical plane between a vertical and a horizontal limit position, lever abutment means carried by said sleeve to abut said lever in said limit positions, said first end portion being, when said lever is in horizontal limit position, in the path of said steps and resting on one of said steps, and being, when said lever is in vertical limit position, disposed at a lower level than said lever pivot, said second end portion extending in the path of said steps in the vertical limit position of said lever and forming a lever counterweight biasing said lever towards its vertical limit position in a range of lever positions between said vertical limit position and a vertically-inclined position in which said second end portion just clears said steps, said lever counterweight biasing said lever towards its horizontal limit position in a range of lever positions between said horizontal limit position and said vertically-inclined position, whereby, upon slow raising or lowering movement of said sleeve along said tower, said lever oscillates between said vertical limit position and said vertically-inclined position and upon lowering movement of said sleeve at a sufficient speed to cause said lever, by impact of said second end portion on a step, to pivot from said vertical limit position beyond said vertically-inclined position, said lever will continue to pivot and attain its horizontal limit position under the bias of said lever counterweight.

18. A self-raising work platform assembly as defined in claim 17, wherein said emergency brake system includes additional levers identical to said lever and vertically pivotally mounted on said sleeve at vertical distances apart between each other and between said lever smaller than the vertical distance between successive steps of said tower.

* * * * *